US009988958B2

(12) United States Patent
You et al.

(10) Patent No.: US 9,988,958 B2
(45) Date of Patent: Jun. 5, 2018

(54) RESONATORS WITH INTERCHANGEABLE METERING TUBES FOR GAS TURBINE ENGINES

(71) Applicant: SIEMENS AKTIENGESELLSCHAFT, München (DE)

(72) Inventors: Danning You, Shanghai (CN); Anthony L. Schiavo, Oviedo, FL (US); John M. Crane, Oviedo, FL (US); Bernd Prade, Mülheim (DE); Werner Krebs, Mülhiem an der Ruhr (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days. days.

(21) Appl. No.: 15/525,982

(22) PCT Filed: Dec. 1, 2014

(86) PCT No.: PCT/US2014/067849

§ 371 (c)(1),
(2) Date: May 11, 2017

(87) PCT Pub. No.: WO2016/089341

PCT Pub. Date: Jun. 9, 2016

(65) Prior Publication Data

US 2017/0314433 A1 Nov. 2, 2017

(51) Int. Cl.
*F23R 3/00* (2006.01)
*F23R 3/60* (2006.01)
(Continued)

(52) U.S. Cl.
CPC ..... *F01N 1/02* (2013.01); *F23R 3/002* (2013.01); *F05D 2260/96* (2013.01);
(Continued)

(58) Field of Classification Search
CPC .. F01N 1/02; F23R 3/002; F23R 2900/00014; F05D 2260/96; F05D 2260/962; F05D 2260/963; F05D 2260/964; F05D 2270/14
(Continued)

(56) References Cited

U.S. PATENT DOCUMENTS 2,788,803 A * 4/1957 Greene ..... F02K 1/04 138/37
3,483,698 A * 12/1969 Ford ..... F02K 9/56 60/725

(Continued)

FOREIGN PATENT DOCUMENTS

EP 1605209 A1 12/2005
EP 2484881 A1 8/2012
EP 2525151 A2 11/2012

OTHER PUBLICATIONS

PCT International Search Report and Written Opinion dated May 7, 2015 corresponding to PCT Application No. PCT/US2014/067849 filed Dec. 1, 2014.

*Primary Examiner* — Lorne Meade
*Assistant Examiner* — Eric Linderman

(57) ABSTRACT

The present disclosure provides a gas turbine combustor including a combustion structure (10) having a combustor liner (14) and a flow sleeve (12). The combustor liner (14) includes inner and outer surfaces (31, 30) and defines a combustion zone (15). The gas turbine combustor further includes a plurality of hollow airfoil-shaped structures (22) affixed to the combustor liner (14) and extending radially outwardly into an airflow space (18) defined radially between the flow sleeve (12) and the combustor liner (14). Each hollow structure (22) includes at least one metering tube (26) providing acoustic communication between the combustion zone (15) and the hollow structure (22). The metering tubes (26) are detachably coupled to the combustor
(Continued)

liner (14) for permitting interchanging of the metering tube (26) with at least one additional metering tube having at least one different dimension to effect a change in an acoustic characteristic of the hollow structure (22).

7 Claims, 6 Drawing Sheets

(51) Int. Cl.
*F23R 3/02* (2006.01)
*F01N 1/02* (2006.01)

(52) U.S. Cl.
CPC .. *F05D 2260/962* (2013.01); *F05D 2260/963* (2013.01); *F05D 2260/964* (2013.01); *F05D 2270/14* (2013.01); *F23R 3/60* (2013.01); *F23R 2900/00014* (2013.01)

(58) Field of Classification Search
USPC ..... 60/39.091, 796
See application file for complete search history.

(56) References Cited

U.S. PATENT DOCUMENTS 3,698,521 A * 10/1972 Taylor ..... F16F 5/00 188/306
3,726,368 A * 4/1973 Taylor ..... F16F 9/003 188/289
5,146,364 A 9/1992 Oku
5,996,733 A * 12/1999 DeTuncq ..... F02M 35/1255 181/250
6,351,947 B1 * 3/2002 Keller ..... F23R 3/002 60/725
7,104,065 B2 9/2006 Benz et al.
7,413,053 B2 8/2008 Wasif et al.
7,552,796 B2 * 6/2009 Baarck ..... F01D 25/30 181/212
7,857,094 B2 12/2010 Macquisten et al.
8,033,358 B2 10/2011 Ivers
8,104,290 B2 * 1/2012 Ellis ..... F23R 3/60 267/158
8,387,396 B2 * 3/2013 Chen ..... F01D 9/023 60/752
8,397,514 B2 * 3/2013 Crawley ..... F23R 3/02 60/752
8,684,130 B1 * 4/2014 Bothien ..... F02C 7/24 123/184.54
8,763,405 B2 * 7/2014 Sordyl ..... F01D 5/185 431/168
8,919,127 B2 * 12/2014 Melton ..... F23R 3/286 415/115
8,991,185 B2 * 3/2015 Huber ..... F23R 3/002 431/114
9,200,537 B2 * 12/2015 Bouchard ..... F02K 1/827
9,447,971 B2 * 9/2016 Kim ..... F23R 3/002
9,857,079 B2 * 1/2018 Huber ..... F23R 3/002
2004/0211185 A1 * 10/2004 Young ..... F23R 3/002 60/725
2004/0248053 A1 * 12/2004 Benz ..... F23R 3/002 431/114
2005/0034918 A1 * 2/2005 Bland ..... F23M 20/005 181/250
2006/0231329 A1 * 10/2006 Borja ..... B64D 33/02 181/250
2007/0102235 A1 * 5/2007 Tobik ..... F01N 1/02 181/250
2007/0169992 A1 * 7/2007 Wasif ..... F23M 20/005 181/293
2008/0216481 A1 * 9/2008 Pollarolo ..... F23R 3/50 60/725
2008/0227562 A1 * 9/2008 Gill ..... A01K 87/08 473/299
2009/0094985 A1 * 4/2009 Johnson ..... F23R 3/002 60/752
2010/0284789 A1 * 11/2010 Brooks ..... F01D 5/26 415/119
2011/0048021 A1 * 3/2011 Slobodyanskiy ..... F01D 9/023 60/725
2011/0138812 A1 * 6/2011 Johnson ..... F23R 3/00 60/725
2011/0220433 A1 * 9/2011 Nakamura ..... F01D 9/023 181/213
2012/0102963 A1 * 5/2012 Corr ..... F23R 3/002 60/772
2012/0230657 A1 9/2012 Uno
2012/0297784 A1 11/2012 Melton et al.
2013/0042619 A1 * 2/2013 Bobba ..... F23R 3/002 60/725
2013/0064661 A1 3/2013 Evans et al.
2013/0091848 A1 4/2013 Manoharan et al.
2013/0247439 A1 * 9/2013 Johnson ..... F41A 13/12 42/97
2013/0291543 A1 * 11/2013 Kim ..... F23R 3/002 60/725
2013/0327011 A1 * 12/2013 Overby ..... F23R 3/28 60/39.091
2015/0020498 A1 * 1/2015 Schilp ..... F23R 3/002 60/39.83
2015/0159878 A1 * 6/2015 Schildmacher ..... F23R 3/58 60/776
2016/0003162 A1 * 1/2016 Beck ..... F23R 3/002 60/725
2016/0144694 A1 * 5/2016 Shchokin ..... B60J 5/107 296/146.4
2016/0376929 A1 * 12/2016 Akturk ..... F15D 1/0025 415/119
2017/0227220 A1 * 8/2017 Schilp ..... F23R 3/002
2017/0268777 A1 * 9/2017 Hase ..... F23R 3/002

* cited by examiner

RESONATORS WITH INTERCHANGEABLE METERING TUBES FOR GAS TURBINE ENGINES

FIELD OF THE INVENTION

The present invention relates generally to gas turbine engines, and more particularly to resonators with interchangeable acoustic metering tubes positioned on a combustor liner of a gas turbine engine.

BACKGROUND OF THE INVENTION

In turbine engines, compressed air discharged from a compressor section and fuel introduced from a source of fuel are mixed together and burned in a combustion section, creating combustion products defining hot combustion gases. The combustion gases are directed through a hot gas path in a turbine section, where they expand to provide rotation of a turbine rotor. The turbine rotor is linked to a shaft to power the compressor section and may be linked to an electric generator to produce electricity.

Combustion produces pressure oscillations within the combustion section, which cause combustion dynamics in the form of acoustic waves. These waves may lead to flame instability, and vibrations that match the natural resonance frequency of one or more engine components can ultimately cause fatigue or wear failure in combustor components. Damping devices such as resonator boxes may be used to suppress or absorb acoustic energy generated during engine operation to keep acoustic oscillations within an acceptable range. Because cooling requirements and space limitations often restrict the ability to damp combustion dynamics, particularly low and intermediate frequency dynamics, fuel staging is often used to mitigate combustion dynamics, which often requires a level of non-homogeneity in the mixture. However, these strategies frequently lead to undesirable pollutant emissions and may limit combustor performance. Mitigation of combustion dynamics is further complicated by the fact that a single component may have multiple natural frequencies, and the resonance frequencies of engine components may change over time.

SUMMARY OF THE INVENTION

In accordance with one aspect of the invention, the present disclosure provides a gas turbine combustor comprising a combustion structure defining a central axis and comprising a combustor liner and a flow sleeve. The combustor liner comprises an inner surface and an outer surface and defines a combustion zone. An airflow space is defined radially between the outer surface of the combustor liner and the flow sleeve. The gas turbine combustor further comprises a plurality of hollow structures that are affixed to and enclose respective portions of the outer surface of the combustor liner and that extend radially outwardly into the airflow space. Each hollow structure comprises an airfoil shape. Each hollow structure comprises at least one metering tube providing acoustic communication between the combustion zone and an interior volume of the hollow structure. The metering tubes are detachably coupled to the combustor liner for permitting interchanging of the metering tube with at least one additional metering tube having at least one different dimension to effect a change in an acoustic characteristic of the respective hollow structure.

In accordance with some aspects, a radially outer surface of each hollow structure may further comprise a detachable cap for allowing access into the interior volume of the hollow structures. In a particular aspect, the detachable cap may be detachably coupled to the radially outer surface of the respective hollow structure via a plurality of tabs. Rotation of the detachable cap causes the tabs to engage surfaces of the hollow structure to form a seal with the hollow structure. In a further particular aspect, the surfaces of the hollow structure that engage the tabs may be inclined radially inward.

In accordance with other aspects of the invention, the combustor liner may further comprise a plurality of hollow bosses affixed to the outer surface of the combustor liner and extending radially outwardly into the interior volume of the respective hollow structure. The hollow bosses are configured to receive the metering tubes within the interior volume of the respective hollow structures. In a particular aspect, an outer tube surface of each metering tube may further comprise an outer threaded portion and a shoulder disposed circumferentially about the outer tube surface. An opening of each hollow boss defines an interior threaded surface that is complementary to the outer threaded portions of the metering tubes such that the shoulder of each metering tube engages a radially outer rim of the respective hollow boss when the metering tubes are inserted into the threaded openings. In a further particular aspect, each metering tube may further comprise a wedge lock washer structure disposed between the shoulder of the metering tube and the radially outer rim of the corresponding hollow boss. The wedge lock washer structures lock the metering tubes in place during operation to prevent the metering tubes from backing out of the corresponding hollow boss.

In accordance with further aspects, the hollow structures may comprise an airfoil shape. In a particular aspect, these airfoil-shaped hollow structures may be circumferentially spaced apart and effect a reduction in swirl of gases passing through the airflow space.

In accordance with a further aspect of the invention, the present disclosure provides methods of servicing a turbine engine component. In one aspect, the method comprises the steps of: accessing an interior volume of a hollow structure affixed to an outer surface of a combustor liner and extending radially outwardly into an airflow space defined between the outer surface of the combustor liner and a flow sleeve located radially outwardly from the combustor liner, in which the hollow structure encloses a portion of the outer surface of the combustor liner and comprises a first metering tube providing acoustic communication between the interior volume of the hollow structure and a combustion zone defined by the combustor liner; removing the first metering tube; and installing a second metering tube in a location where the first metering tube was removed, in which the second metering tube has at least one different dimension as compared to the first metering tube.

In accordance with one aspect of the method, the hollow structure comprises an airfoil shape. In accordance with other aspects of the method, accessing the interior volume of the hollow structure may comprise removing a cap detachably coupled to a radially outer surface of the hollow structure. In a particular aspect, the method may further comprise reattaching the cap to the radially outer surface of the hollow structure after the second metering tube is installed in the hollow structure.

In accordance with further aspects of the method, outer tube surfaces of each of the first and second metering tubes may comprise an outer threaded portion and a shoulder disposed circumferentially about the outer tube surface, and the portion of the combustor liner enclosed by the hollow structure may comprise a hollow boss configured to receive the first and second metering tubes. The hollow boss extends radially outwardly into the interior volume of the respective hollow structure. In accordance with a particular aspect of the method, an opening of the hollow boss defines an interior threaded surface that is complementary to the outer threaded portions of the first and second metering tubes such that the shoulder of each metering tube engages a radially outer rim of the hollow boss when the metering tubes are inserted into the hollow boss. In this particular aspect of the method, removing the first metering tube may comprise unscrewing the first metering tube from the hollow boss and installing the second metering tube may comprise threading the second metering tube into the hollow boss such that the shoulder of the second metering tube engages the radially outer rim of the hollow boss.

In accordance with another aspect of the method, the first metering tube may be configured to damp a first resonance frequency within the hollow structure, and the second metering tube may be configured to damp a second resonance frequency within the hollow structure, in which the second resonance frequency is different than the first resonance frequency.

In accordance with a further aspect of the invention, the present disclosure provides methods of damping a plurality of resonance frequencies in a gas turbine engine. The gas turbine engine includes a combustion structure comprising a combustor liner that defines a combustion zone and a flow sleeve disposed radially outwardly from the combustor liner. The flow sleeve cooperates with the combustor liner to define an airflow space between the flow sleeve and combustor liner. In one aspect, the method comprises the steps of: providing a plurality of hollow structures extending radially outwardly into the airflow space, with the hollow structures being affixed to and enclosing respective portions of an outer surface of the combustor liner; installing at least one interchangeable metering tube in at least one of the hollow structures, in which each interchangeable metering tube is configured to damp a select resonance frequency within the corresponding hollow structure; determining that a different resonance frequency is to be damped within at least one of the hollow structures that includes an interchangeable metering tube; removing, from the at least one hollow structure within which a different resonance frequency is to be damped, the interchangeable metering tube; and installing, into the at least one hollow structure within which a different resonance frequency is to be damped, an additional interchangeable metering tube into the combustor liner where the interchangeable metering tube was located. Each interchangeable metering tube is detachably coupled to the combustor liner and provides acoustic communication between the combustion zone and an interior volume of the corresponding hollow structure. The additional interchangeable metering tube is configured to damp the different resonance frequency.

In accordance with some aspects of the method, outer tube surfaces of each of the interchangeable metering tubes comprise an outer threaded portion and a shoulder disposed circumferentially about the outer tube surface, and the portion of the combustor liner enclosed by the hollow structure within which a different resonance frequency is to be damped comprises a hollow boss configured to receive each of the interchangeable metering tubes. The hollow boss further comprises an interior threaded portion that is complementary to the outer threaded portions of each of the interchangeable metering tubes. In this particular aspect of the method, removing the interchangeable metering tube comprises unscrewing the interchangeable metering tube from the hollow boss, and installing the additional interchangeable metering tube comprises threading the additional interchangeable metering tube into the hollow boss such that the shoulder of the additional interchangeable metering tube engages a radially outer rim of the corresponding hollow boss. In accordance with other aspects of the method, the hollow structures comprise an airfoil shape.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
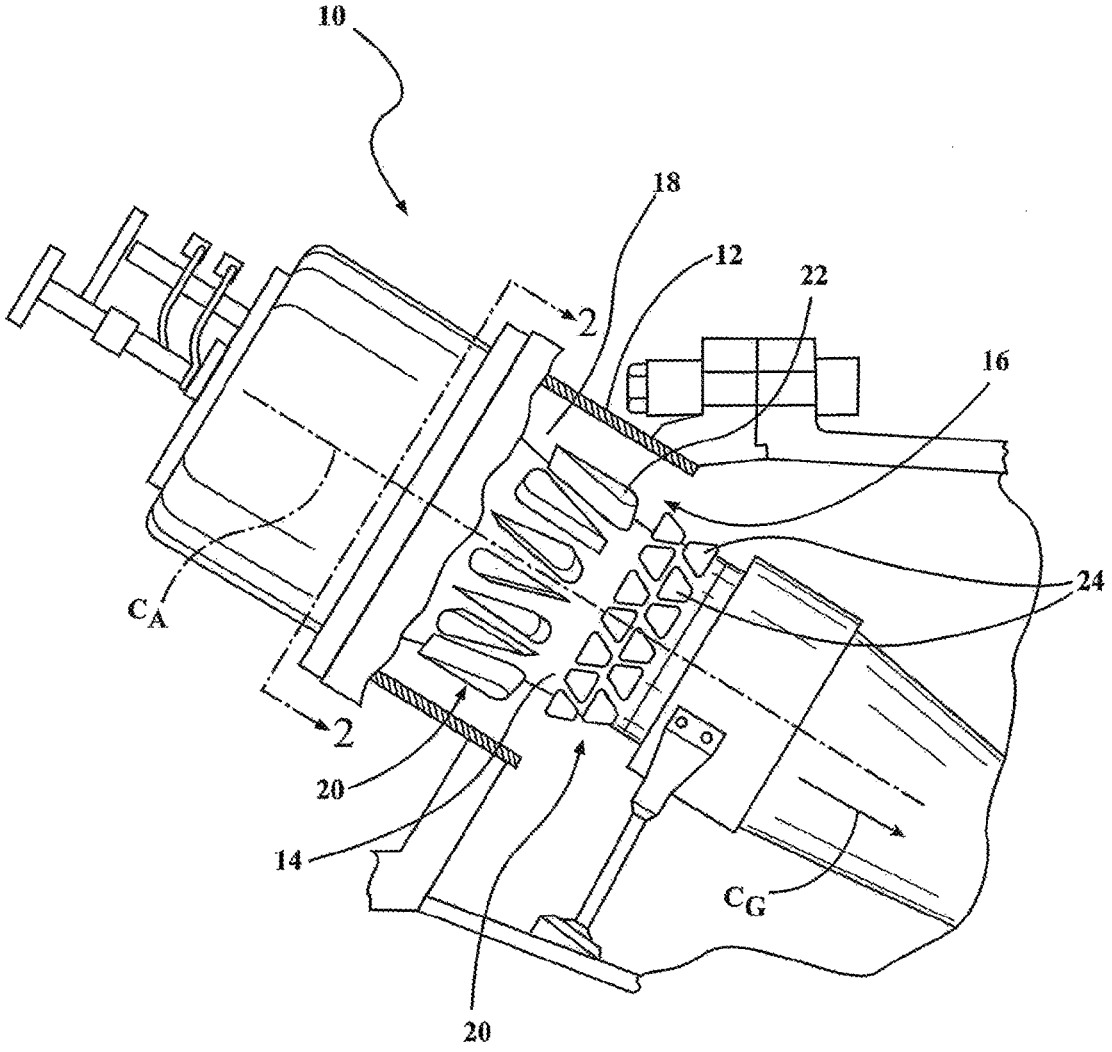
FIG. 1 is a side view partially in cross section of a combustor section of a gas turbine engine incorporating a plurality of resonator structures in accordance with aspects of the invention, in which a portion of the combustor liner is removed.
Figure 2:
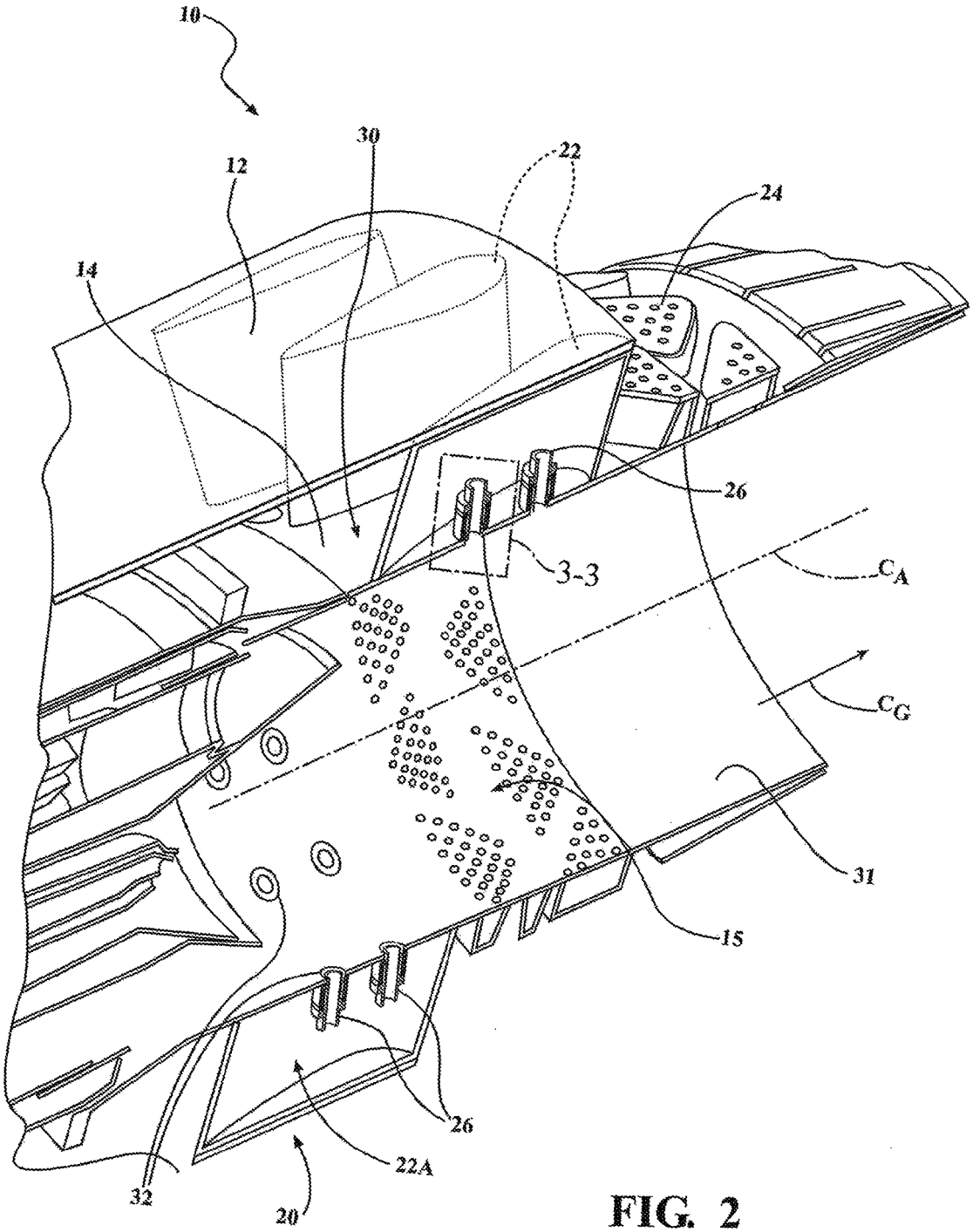
FIG. 2 is an enlarged perspective view partially in cross section of the combustor section illustrated in FIG. 1 taken along line 2-2.

In FIGS. 1 and 2, a combustor section or structure 10 from a gas turbine engine (not separately labeled) is illustrated, including a flow sleeve 12 and a combustor liner 14 defining a combustion zone 15. It is noted that portion of the combustor liner 14 is removed in FIG. 1 to show selected internal structures within the combustor structure 10, which will be described herein. The combustor structure 10 defines a central axis $C_A$. A compressor section (not shown) of the gas turbine engine compresses ambient air, a portion of which ultimately enters an inlet 16 into an airflow space 18 defined radially between the combustor liner 14 and the flow sleeve 12. The combustor structure 10 combines the compressed air with a fuel and ignites the mixture, creating combustion products comprising hot combustion gases $C_G$ flowing through the combustion zone 15. An inner surface 31 of the combustor liner 14 (see FIG. 2) is in contact with the hot combustion gases $C_G$, which then travel to a turbine section (also not shown) of the gas turbine engine. The combustor liner 14 may comprise any suitable cross-sectional shape, such as the substantially circular cross-sectional shape depicted in FIGS. 1 and 2, as well as, for example, oval or rectangular. In addition, the combustor liner 14 may transition between different shapes, such as, for example from a generally circular to a generally rectangular cross-sectional shape.

As used throughout, unless otherwise noted, the terms "circumferential," "axial," "inner/radially inward," "outer/radially outward," and derivatives thereof are used with reference to the central axis $C_A$ of the combustor liner 14, and the terms "upstream" and "downstream" are used with reference to a flow of hot combustion gases $C_G$ through the combustion zone 15 toward the turbine section.

Figure 3:
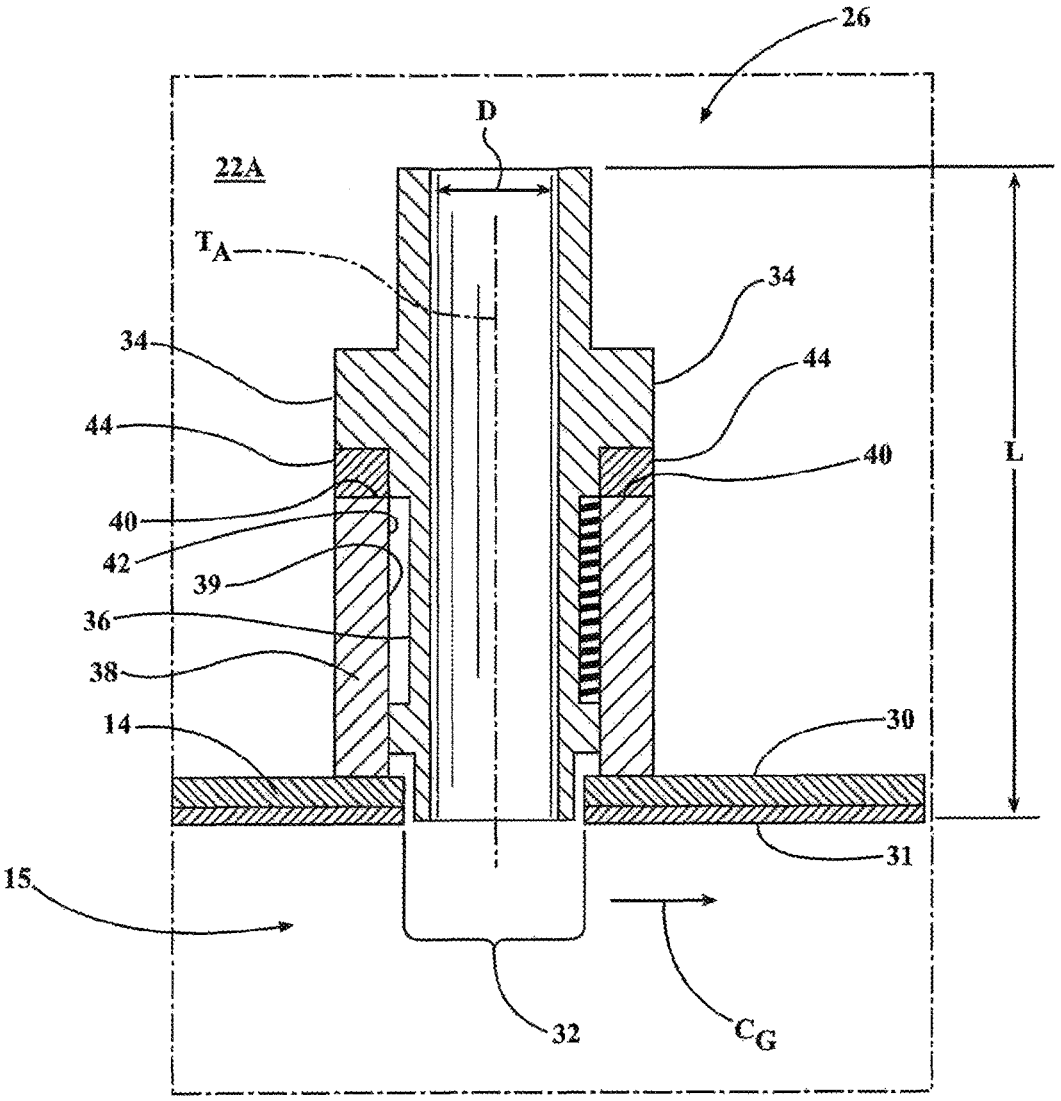
FIG. 3 is an enlarged cross-sectional view of an interchangeable acoustic metering tube from section 3-3 in FIG. 2.

With reference to FIGS. 1-3, distributed circumferentially about and affixed to the combustor liner 14 are resonator structures 20 comprising a plurality of hollow structures, also referred to herein as resonator boxes 22. Each resonator box 22 is affixed directly to and encloses a portion of the outer surface 30 of the combustion liner 14. An annular array of airfoil-shaped resonator boxes 22 are disposed toward an upstream end of the combustor structure 10 and extend in a radially outer direction into and through the airflow space 18 defined between the combustor liner 14 and the flow sleeve 12. The airfoil-shaped resonator boxes 22 comprise one or more acoustic metering tubes 26 detachably mounted or coupled to the combustor liner 14. The combustor liner 14 comprises a plurality of apertures 32 configured to receive the acoustic metering tubes 26. The apertures 32 extend through a thickness of the combustor liner 14 from the inner surface 31 of the combustor liner 14 into a hollow interior volume 22A of the airfoil-shaped resonator boxes 22.

The combustor liner 14 with the airfoil-shaped resonator boxes 22 may optionally comprise one or more additional resonator structures 20 disposed downstream of the airfoil-shaped resonator boxes 22. These additional resonators 24 may comprise any known shape, such as rectangular or trapezoid, and may further comprise a plurality of metering holes that extend through the thickness of the combustor liner 14.

Referring now to FIG. 3, the acoustic metering tube 26 according to the embodiment shown is detachably coupled to the outer surface 30 of the combustor liner 14 and extends radially outwardly from the combustor liner 14 into the interior volume 22A of the airfoil-shaped resonator box 22. The aperture 32 extends through the thickness of the combustor liner 14 such that the interior volume 22A of the airfoil-shaped resonator box 22 and the combustion zone 15 are in acoustic communication. The acoustic metering tube 26, which is received in the aperture 32, acts as a Helmholtz resonator neck to damp combustion frequency dynamics occurring in the combustion zone 15, as will be discussed in more detail below.

Acoustic metering tubes according to the present invention are removable and interchangeable with one or more additional acoustic metering tubes differing in at least one dimension. For example, acoustic metering tubes of varying length, internal diameter, and/or internal geometry may be interchanged as desired to effect a change in an acoustic characteristic of the respective hollow structure. In the exemplary embodiment shown in FIG. 3, the acoustic metering tube 26 comprises a shoulder 34 and an outer threaded portion 36 that is disposed circumferentially about the acoustic metering tube 26 relative to an axis $T_A$ of the acoustic metering tube 26.

Surrounding the acoustic metering tube 26 is a hollow boss 38 that is affixed to and extends radially outwardly from the outer surface 30 of the combustor liner 14 into the interior volume 22A of the airfoil-shaped resonator box 22. The hollow boss 38 may be, for example, welded to the combustor liner 14. An opening 39 of the hollow boss 38 is configured to receive the acoustic metering tube 26 and aligns with the aperture 32 extending through the combustor liner 14. A radially outer rim 40 of the hollow boss 38 engages the shoulder 34 of the acoustic metering tube 26, and the opening 39 of the hollow boss 38 defines an interior threaded surface 42 that is complementary to the outer threaded portion 36 of the acoustic metering tube 26. It is noted that a portion of the threading is removed in FIG. 3 to show selected structures within the junction between the acoustic metering tube 26 and the hollow boss 38. The acoustic metering tube 26 may be installed into the opening 39 of the hollow boss 38, for example, by threading or screwing the acoustic metering tube 26 into the hollow boss 38 such that the interior threaded surface 42 of the hollow boss 38 engages the outer threaded portion 36 of the acoustic metering tube 26 and secures the acoustic metering tube to the combustor liner 14 in a desired position. The acoustic metering tube 26 may then be removed by unscrewing the acoustic metering tube 26 from the hollow boss 38 and replaced with another acoustic metering tube with the same or different dimensions. As explained in more detail herein, it should be noted that acoustic metering tubes 26 according to the present invention may be exchanged by accessing the interior volume 22A of the airfoil-shaped resonator boxes 22 with no need to access the inner surface 31 of the combustor liner 14 and/or the combustion zone 15.

As further illustrated in FIG. 3, a wedge lock washer structure 44 may be disposed circumferentially about the acoustic metering tube 26 relative to the axis $T_A$, in which the wedge lock washer structure 44 is sandwiched between the shoulder 34 of the acoustic metering tube 26 and the radially outer rim 40 of the hollow boss 38. When an acoustic metering tube 26 is secured to the combustor liner 14, i.e., by engagement with the hollow boss 38, the wedge lock washer structure 44 locks the acoustic metering tube 26 in place. For example, the wedge lock washer structure 44 may be a NORD-LOCK® type wedge lock washer (NORD-LOCK is a registered trademark of Nord-Lock International AB, a corporation located in Sweden) having a plurality of radially extending grooves that prevent the acoustic metering tube 26 from backing out of the opening 39 of the hollow boss 38. Torque may be applied to the acoustic metering tube 26 to compress the wedge lock washer structure 44 between the radially outer rim 40 and the shoulder 34.

In addition, although the interchangeable acoustic metering tubes 26 according to the present invention are illustrated in conjunction with airfoil-shaped resonator boxes 22 that extend radially outwardly into the airflow space 18, it is noted that the interchangeable tubes 26 may also be used with resonator boxes comprising any suitable shape and/or location within the combustor structure 10. The interchangeable acoustic metering tubes 26 according to the present invention may further be used in resonator structures that also include conventional fixed metering tubes. Moreover, in some instances, the resonator boxes of one or more of the resonator structures may include acoustic metering tubes of differing dimensions as compared to others of the resonator boxes in order to effect damping of multiple resonance frequencies.

With reference to FIG. 2, interchangeable acoustic metering tubes 26 as described herein may be used to efficiently replace worn or broken metering tubes in one or more resonator boxes 22. Additionally, the acoustic metering tubes 26 can be interchanged with acoustic metering tubes 26 of differing dimensions to achieve damping desired resonance frequencies in gas turbine engines, all without requiring costly servicing of conventional resonator boxes, the combustion liner 14, and/or other engine components. For example, the interchangeable acoustic metering tubes 26 may be used to damp intermediate frequency dynamics (IFD), which typically fall within the range of 100 to 1000 Hz. IFD have proven particularly difficult to address with conventional configurations and currently limit performance of many combustion systems. Reduction or elimination of IFD using the presently disclosed structures and methods may allow removal of one or more fuel stages, thereby reducing system complexity and promoting improved performance characteristics through increased firing temperatures and lower pollution levels.

Figure 4:
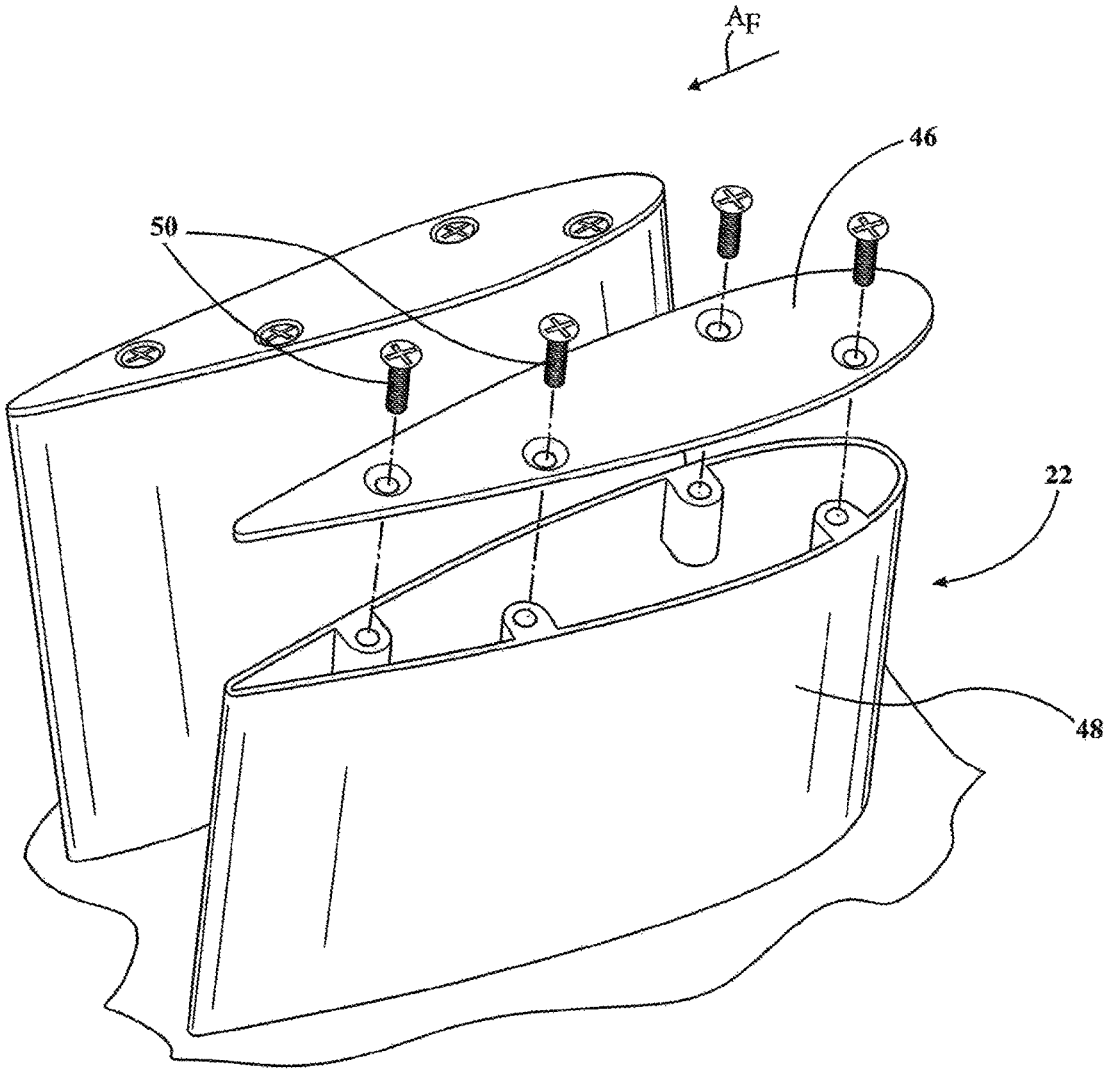
FIG. 4 is an exploded view of an airfoil-shaped hollow structure in accordance with aspects of the invention.

Referring now to FIGS. 4 and 5, a portion of the resonator box 22 may be removable so that the interior volume 22A of the resonator box may be accessed to replace or exchange one or more of the acoustic metering tubes 26. In FIG. 4, the airfoil-shaped resonator box 22 is illustrated having a radially outer surface 46 that is removably coupled to a main body 48 of the airfoil-shaped resonator box 22. The radially outer surface 46 may be coupled to the main body 48 via one or more suitable fasteners, such as one or more screws 50 as depicted in FIG. 4, although other suitable types of fasteners may be used. The fasteners are preferably recessed radially inward with respect to the radially outer surface 46 so that the fasteners do not extend radially outwardly from the radially outer surface 46 into the airflow path (not labeled), such that an incoming airflow $A_F$ over the radially outer surface 46 is substantially unaffected.

Figure 5A:
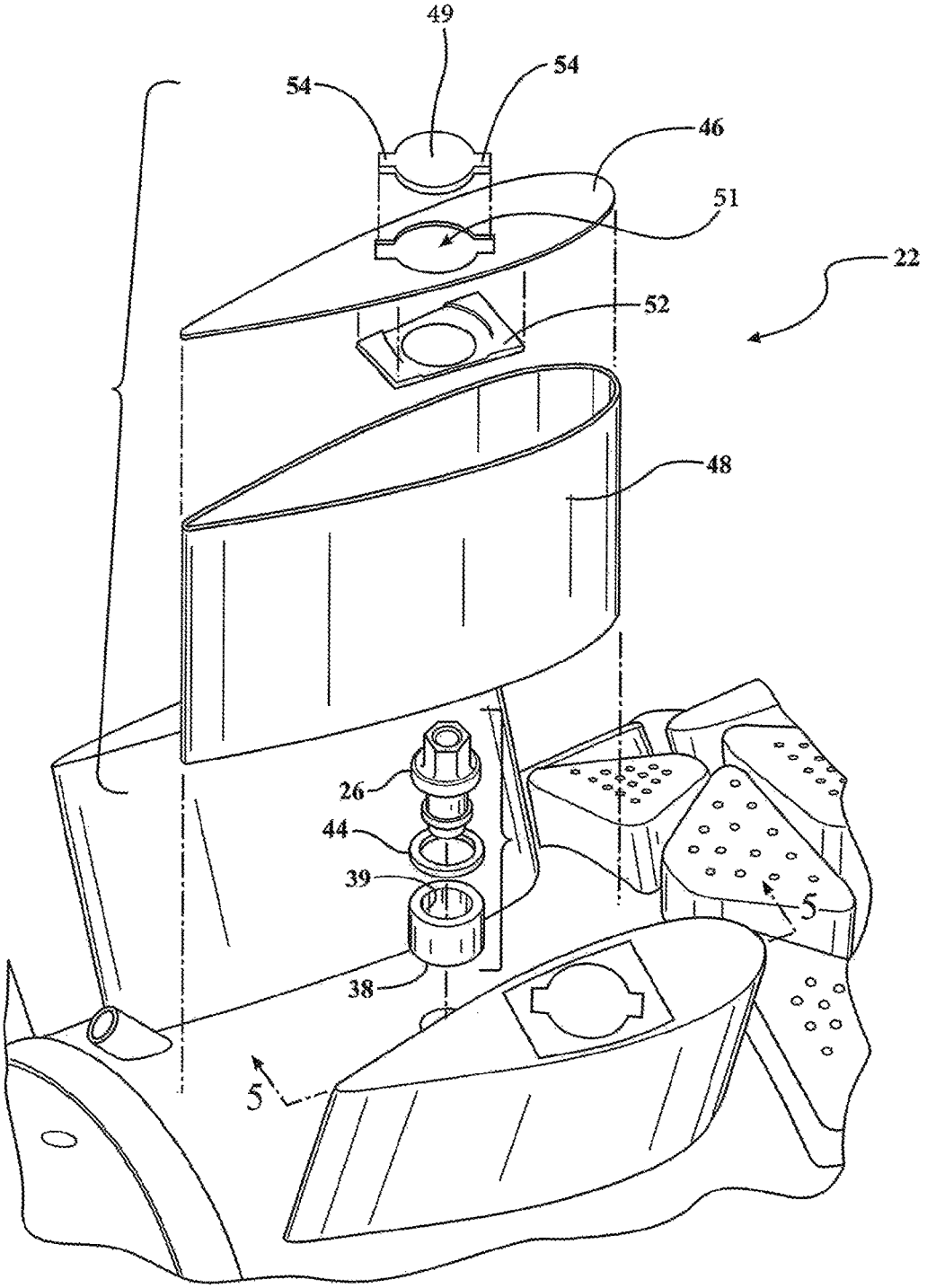
FIG. 5A is an exploded view of another airfoil-shaped hollow structure in accordance with another aspect of the invention.
Figure 5B:
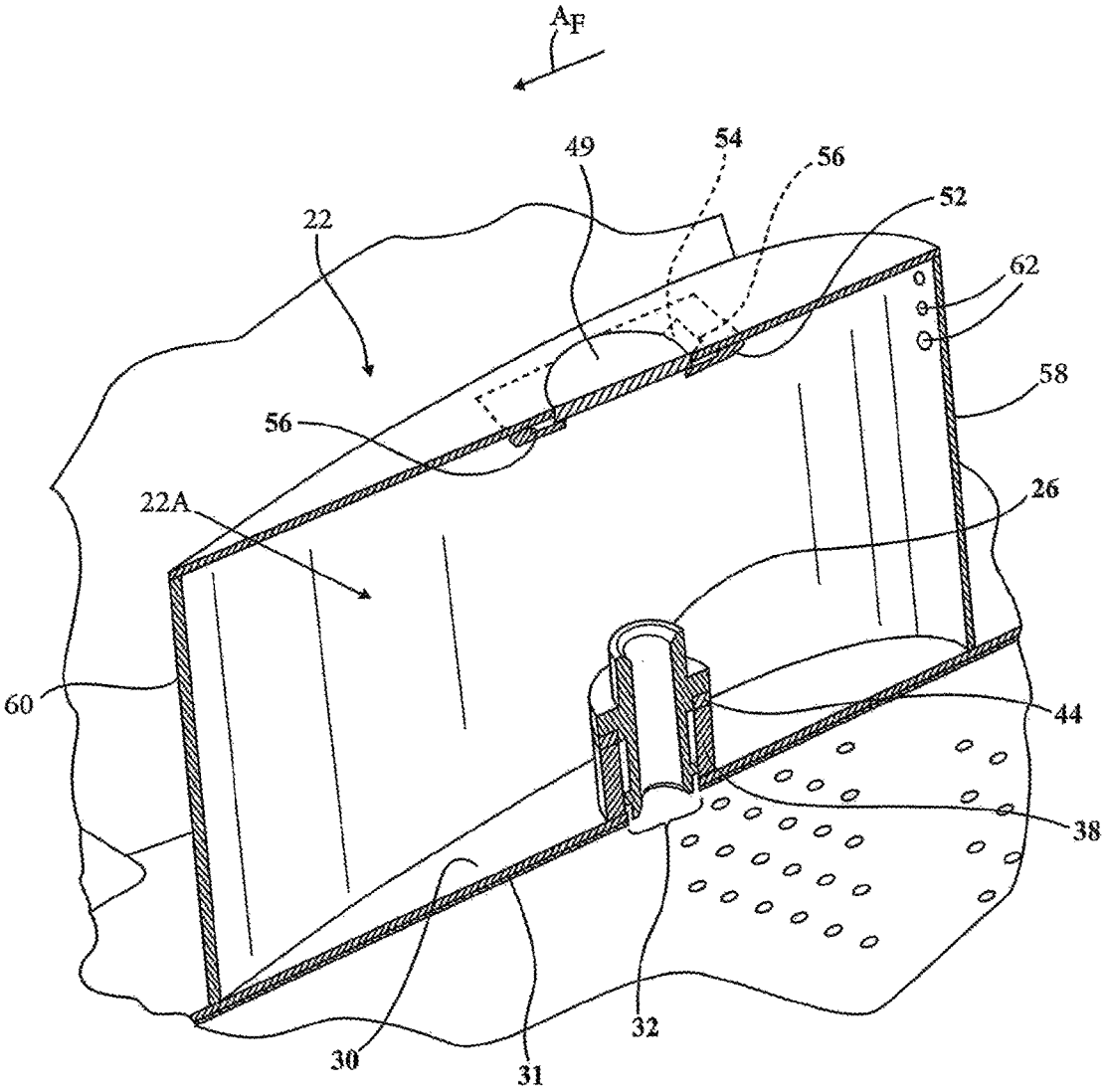
FIG. 5B is an enlarged perspective view partially in cross section of the airfoil-shaped hollow structure illustrated in FIG. 5A taken along line 5-5.

In another exemplary embodiment depicted in FIGS. 5A and 5B, the radially outer surface 46 of the airfoil-shaped resonator box 22 may further comprise a removable or detachable cap 49 that allows access to the interior volume 22A of the airfoil-shaped resonator box 22. In this embodiment, the radially outer surface 46 may be affixed to the main body 48 of the airfoil-shaped resonator 22, such as by welding. The radially outer surface 46 according to this embodiment comprises a complementary aperture 51 that accepts the detachable cap 49. A retainer plate 52 may be located at the inside of the radially outer surface 46 to receive and secure the detachable cap 49. For example, the detachable cap 49 may further comprise a plurality of tabs 54, wherein rotation of the detachable cap 49 causes the tabs 54 to engage blind slots 56 located between and defined by the retainer plate 52 and the radially outer surface 46 to form a captured seal that locks the detachable cap 49 in place as shown in FIG. 5B. In some embodiments, a portion of the blind slots 56 may be inclined radially inward to assist with locking the detachable cap 49 in place. As shown in FIGS. 5A and 5B, the detachable cap 49 may be coupled to the radially outer surface 46 such that the detachable cap 49 is radially aligned with the location of the hollow boss 38 that secures the acoustic metering tube 26 to the combustor liner 14 to allow easy access to the acoustic metering tube 26.

With reference to FIGS. 5A and 5B, each airfoil-shaped resonator box 22 comprises a leading edge 58 and a trailing edge 60, with the leading edge 58 facing the incoming airflow $A_F$. The body 48 of the airfoil-shaped resonator box 22 may optionally comprise one or more holes 62. The holes 62 may be placed at one or more suitable locations along the body 48 to help to reduce dynamic responses from the combustion process and to provide a cooling airflow to the interior volume 22A of the airfoil-shaped resonator box 22, the acoustic metering tube 26, and/or the portion of the outer surface 30 of the combustor liner enclosed by the airfoil-shaped resonator box 22. In the exemplary embodiment shown in FIG. 5B, the airfoil-shaped resonator box 22 comprises a plurality of holes 62 located along the leading edge 58.

Use of an interchangeable acoustic metering tube according to the present invention allows the resonance frequency to be efficiently adapted as needed to response to changing combustion frequency dynamics. With reference to FIGS. 2 and 3, in one exemplary aspect of the invention, to match the resonance frequency of the acoustic metering tube 26 with the frequency that is to be damped, the following simplified equation may be used, in which V is the resonator volume (i.e. 22A), L is the length of the metering tube 26 as shown in FIG. 3, and A is the cross-sectional area of the resonator neck opening (in FIG. 3, D is the diameter of the resonator neck and A is $\pi*D^2/4$):

$$\sqrt{A/V*L}$$

Additionally, as seen in FIGS. 1, 2, 4, and 5B, the airfoil-shaped resonator boxes 22 (with or without the interchangeable acoustic metering tubes 26) that extend radially outwardly into the airflow space 18 further allow conditioning of the incoming airflow $A_F$ upstream of the combustor head. The airfoil shape of the resonator boxes 22 removes or reduces swirl of the compressed air entering the airflow space 18 and effects a flow straightening without incurring an unacceptably large pressure drop. The shape and circumferential spacing of the airfoil-shaped resonators 22 may also be used to achieve this desired reduction in swirl. In accordance with an exemplary aspect of the present invention, the airfoil-shaped resonator boxes 22 may have a ratio of spanwise width to chord length of about 0.24. In other exemplary aspects, a ratio of a circumferential distance to a neighboring resonator to chord length may be about 0.1 to 0.5. Use of one or more of these ratios is believed to be effective in reducing swirl, straightening the flow, and/or minimizing pressure drop. Other aspects of the resonator box and the airfoil shape, such as the resonator volume, angle of the airfoil with respect to incoming airflow, chord or radial tapering and/or twisting of the airfoil, etc., may also be varied and optimized to achieve desired damping characteristics and/or flow conditioning benefits.

The present invention further includes methods of using interchangeable metering tubes as disclosed herein to service a gas turbine engine component and to damp a plurality of resonance frequencies in a gas turbine engine. For illustration purposes, reference is made herein to the components of FIGS. 1-5, but the presently disclosed methods may be implemented with other suitable components and configurations without departing from the scope and spirit of the invention. The gas turbine engine includes a combustion structure 10 comprising a combustor liner 14 that defines a combustion zone 15 and a flow sleeve 12 disposed radially outwardly from the combustor liner 14. The flow sleeve 12 cooperates with the combustor liner 14 to define an airflow space 18 therebetween. A plurality of hollow structures such as resonator boxes 22 are affixed directly to and enclose respective portions of an outer surface 30 of the combustor liner 14 and extend radially outwardly into the airflow space 18. In some embodiments of the methods, the resonator boxes 22 comprise airfoil-shaped resonator boxes 24. One or more of the hollow structures 22 comprises one or more interchangeable metering tubes such as an acoustic metering tube 26 that is configured to damp a select resonance frequency within the corresponding hollow structure 22. Each interchangeable acoustic metering tube 26 is detachably coupled to the combustor liner 14 and provides acoustic communication between the combustion zone 15 and an interior volume 22A of the corresponding hollow structure 22.

The methods include accessing the interior volume of one or more of the hollow structures so that at least one of the metering tubes can be removed and a second metering tube can be installed in a location from which the first metering tube was removed. In some cases, the first metering tube may be damaged or broken and may require replacement with a new metering tube with the same or different dimensions. In other instances, it has been determined that a different resonance frequency within the combustor structure is to be damped, in which case the first metering tube may be replaced with a second metering tube differing in at least one dimension as compared to the first metering tube. In accordance with one aspect of the present invention, the step of accessing the interior volume of the hollow structure may comprise removing a cap from the hollow structure. The cap may comprise, for example, the detachable cap 49 depicted in FIG. 5A that is detachably coupled to the radially outer surface 46 of the hollow structure 22. Methods according to this aspect of the invention may further comprise reattaching the cap to the radially outer surface following installation of the second metering tube in the hollow structure.

It is noted that in all aspects of the method, the step of accessing the interior volume of the hollow structure is performed by removing all or part of a radially outer surface of the hollow structure so that the metering tubes may be removed or installed without accessing the combustion zone or inner surface of the combustor liner. Thus, there is no need to remove the hollow structures from the combustor liner or to disassemble the hollow structures and/or any other component of the gas turbine combustor in order to exchange the metering tubes.

Also in accordance with the present invention, as depicted in FIG. 3, the outer surfaces of each of the first and second metering tubes 26 may comprise an outer threaded portion 36 and a shoulder 34 disposed circumferentially about the outer tube surface of the acoustic metering tube 26. The portion of the combustor liner 14 enclosed by the hollow structure 22 comprises an aperture 32 configured to receive the acoustic metering tube 26. In accordance with some aspects of the invention, the aperture may comprise a hollow boss 38 that includes a radially outer rim 40 and an interior threaded surface 42 that is complementary to and engages with the outer threaded portions 36 of the respective metering tubes 26. Removing the first metering tube may comprise unscrewing the first metering tube from the hollow boss, and installing the second metering tube may comprise threading the second metering tube into the hollow boss such that the shoulder of the second metering tube engages the radially outer rim surrounding the hollow boss. It is noted that the interchangeable metering tubes according to the present invention serve no structural purpose within the gas turbine combustor, i.e. attachment of the combustor liner to the combustor structure and/or attachment of the resonator boxes to the combustor liner, and thus may be removed in their entirety from the combustor liner during servicing with no detrimental effects.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine combustor comprising:

a combustion structure defining a central axis and comprising a combustor liner and a flow sleeve, the combustor liner including an inner surface and an outer surface, wherein an airflow space is defined radially between the outer surface of the combustor liner and the flow sleeve and wherein a combustion zone is defined within the combustor liner;

a plurality of hollow structures affixed to and enclosing respective portions of the outer surface of the combustor liner and extending radially outwardly into the airflow space, each respective hollow structure of the plurality of hollow structures defining an airfoil shape Helmholtz resonator, wherein the respective hollow structure of the plurality of hollow structures comprises at least one metering tube providing acoustic communication between the combustion zone and an interior volume of the respective hollow structure of the plurality of hollow structures, the at least one metering tube-being detachably coupled to the combustor liner for permitting interchanging of the at least one metering tube with at least one additional metering tube having at least one different configuration relative to the configuration of the at least one metering tube to effect a change in an acoustic characteristic of the respective hollow structure of the plurality of hollow structures, wherein the at least one different configuration of the at least one additional metering tube is selected from the group consisting of length of the at least one additional metering tube, internal diameter of the at least one additional metering tube, and internal geometry of the at least one additional metering tube, wherein the combustor liner further comprises a plurality of hollow bosses affixed to the outer surface of the combustor liner each respective hollow boss of the plurality of hollow bosses extending radially outwardly into the interior volume of the respective hollow structure of the plurality of hollow structures, the respective hollow boss of the plurality of hollow bosses being configured to receive the at least one metering tube.

2. The gas turbine combustor of claim 1, wherein a radially outer surface of the respective hollow structure of the plurality of hollow structures further comprises a detachable cap for allowing access into the interior volume of the respective hollow structure of the plurality of hollow structures.

3. The gas turbine combustor of claim 2, wherein the detachable cap is detachably coupled to the radially outer surface of the respective hollow structure of the plurality of hollow structures via a plurality of tabs, and wherein rotation of the detachable cap causes the plurality of tabs to engage surfaces of the respective hollow structure of the plurality of hollow structures to form a seal with the respective hollow structure of the plurality of hollow structures.

4. The gas turbine combustor of claim 3, wherein the engaging surfaces of the respective hollow structure of the plurality of hollow structures that engage the plurality of tabs are inclined radially inward.

5. The gas turbine combustor of claim 1, wherein an outer tube surface of the at least one metering tube further comprises an outer threaded portion and a shoulder disposed circumferentially about the outer tube surface, and wherein an opening of the respective hollow boss of the plurality of hollow bosses defines an interior threaded surface, the interior threaded surface of the respective hollow boss of the plurality of hollow bosses and the outer threaded portions of the at least one metering tube being complementary such that the shoulder of the at least one metering tube engages a radially outer rim of the respective hollow boss of the plurality of hollow bosses when the at least one metering tube is inserted into the respective hollow boss of the plurality of hollow bosses.

6. A gas turbine combustor comprising:

a combustion structure defining a central axis and comprising a combustor liner and a flow sleeve, the combustor liner including an inner surface and an outer surface, wherein an airflow space is defined radially between the outer surface of the combustor liner and the flow sleeve and wherein a combustion zone is defined within the combustor liner;

a plurality of hollow structures affixed to and enclosing respective portions of the outer surface of the combustor liner and extending radially outwardly into the airflow space, each respective hollow structure of the plurality of hollow structures comprising an airfoil shape Helmholtz resonator, wherein the respective hollow structure of the plurality of hollow structures comprises at least one metering tube providing acoustic communication between the combustion zone and an interior volume of the respective hollow structure of the plurality of hollow structures, the at least one metering tube being detachably coupled to the combustor liner for permitting interchanging of the at least one metering tube with at least one additional metering tube having at least one different dimension to effect a change in an acoustic characteristic of the respective hollow structure of the plurality of hollow structures, wherein the combustor liner further comprises a plurality of hollow bosses affixed to the outer surface of the combustor liner, each respective hollow boss of the plurality of hollow bosses extending radially outwardly into the interior volume of the respective hollow structure of the plurality of hollow structures, the respective hollow boss of the plurality of hollow bosses being configured to receive the at least one metering tube, wherein an outer tube surface of the at least one metering tube further comprises an outer threaded portion and a shoulder disposed circumferentially about the outer tube surface, and wherein an opening of the respective hollow boss of the plurality of hollow bosses defines an interior threaded surface, the interior threaded surface of the respective hollow bus of the plurality of hollow bosses and the outer threaded portion of the at least one metering tube being complementary such that the shoulder of the at least one metering tube engages a radially outer rim of the respective hollow boss of the plurality of hollow bosses when the at least one metering tube is inserted into the respective hollow bus of the plurality of hollow bosses, wherein the at least one metering tube further comprises a wedge lock washer structure disposed between the shoulder of the at least one metering tube inserted into the respective hollow bus and the radially outer rim of the respective hollow boss, wherein the wedge lock washer structure locks the at least one metering tube in place during operation to prevent the at least one metering tube inserted into the respective hollow bus from backing out of the respective hollow boss.

7. The gas turbine combustor of claim 6, wherein the plurality of hollow structures is circumferentially spaced apart and effect a reduction in swirl of gases passing through the airflow space.

* * * * *